US009745753B1

(12) United States Patent
Petersen

(10) Patent No.: US 9,745,753 B1
(45) Date of Patent: Aug. 29, 2017

(54) NOTCHED POLYMER ROOFING BATTEN WITH MEASURED DETACHABLE SECTIONS

(71) Applicant: Petersen-Dean, Inc., Fremont, CA (US)

(72) Inventor: James Patrick Petersen, Fremont, CA (US)

(73) Assignee: PETERSEN-DEAN, INC., Fremont, CA (US)

( * ) Notice: Subject to any disclaimer, the term of this patent is extended or adjusted under 35 U.S.C. 154(b) by 0 days.

(21) Appl. No.: 15/341,566

(22) Filed: Nov. 2, 2016

(51) Int. Cl.
*E04D 12/00* (2006.01)

(52) U.S. Cl.
CPC ..... *E04D 12/004* (2013.01)

(58) Field of Classification Search
CPC ..... E04D 12/004
See application file for complete search history.

(56) References Cited

U.S. PATENT DOCUMENTS 4,090,435 A * 5/1978 Vallee ..... E04D 13/174 454/365
5,197,252 A 3/1993 Tiscareno
5,471,807 A 12/1995 Vasquez
6,453,630 B1 9/2002 Buhrts et al.
6,718,719 B1 4/2004 Hagerty
RE39,825 E 9/2007 Morris et al.
7,735,275 B2 6/2010 Vandewater, Jr.
8,033,073 B1 10/2011 Binder
8,141,312 B1 3/2012 Koble et al.
8,453,399 B2 6/2013 Anderson
8,544,239 B2 * 10/2013 Mora ..... E04D 12/00 52/478
2006/0150536 A1 7/2006 Smith
2008/0017446 A1 * 1/2008 Borra ..... E04G 5/04 182/45

FOREIGN PATENT DOCUMENTS

FR 2426781 A * 12/1979
WO WO2006107190 10/2006

* cited by examiner

*Primary Examiner* — Jeanette E Chapman
(74) *Attorney, Agent, or Firm* — Gordon Rees Scully Mansukhani LLP; David R. Heckadon

(57) ABSTRACT

A notched plastic roofing batten with a pair of side walls having V-shaped notches at regular intervals therealong such that measured sections of the batten can be removed to achieve a desired overall length in the field by manually cutting or breaking the batten at one of the V-shaped notches.

15 Claims, 5 Drawing Sheets

NOTCHED POLYMER ROOFING BATTEN WITH MEASURED DETACHABLE SECTIONS

TECHNICAL FIELD

The present invention relates to roofing battens.

BACKGROUND OF THE INVENTION

Roofing battens are traditionally made of wood and are positioned parallel to one another to provide a structure onto which roofing tiles or shingles are attached. During roof construction or repair, battens need to be cut to desired lengths to fit the particular shape and dimensions of the roof. Unfortunately, removing, replacing and/or resizing battens is a complex and time-consuming task requiring the wooden battens to be measured and cut by the workers on the roof. This requires the workers bring power saws up onto the roof.

It would instead be desirable to provide a batten that is easier to work with and can quickly be cut to the desired size without the use of power tools. Ideally, such a batten would be tough, durable and long-lasting yet still be lightweight. Ideally as well, such a batten would be held in place by screws rather than nails since screws would provide a more solid connection than traditional nails.

SUMMARY OF THE INVENTION

The present invention provides a notched plastic roofing batten that can be easily cut or broken apart such that pre-measured sections of the batten can be quickly removed in the field to adjust the overall length of the batten.

In a preferred embodiment, the batten has a pair of upwardly extending side walls having V-shaped notches at regular intervals therealong. Indicia printed, stamped or otherwise marked onto the batten shows the worker the length of the batten at each of the V-shaped notches. As a result, pre-measured sections can easily be removed to achieve a desired overall length in the field. Preferably, the pre-measured sections can be manually cut or broken off of the batten at one of the V-shaped notches. As such, the present batten can be shortened by being cut at the notched locations without using any power tools. As such, it is not necessary for workers to bring power saws up onto the roof.

In one optional embodiment, the present batten system comprises: an elongated body; a pair of side walls extending along opposite sides of the elongated body and a plurality of pre-formed notches that are spaced-apart at intervals along a length of each of the side walls. The pre-formed notches are preferably spaced apart equidistantly from one another, and are V-shaped.

Preferably, the present batten is made from a plastic polymer that optionally incorporates a UV resistance material. As such, an advantage of the present batten is that it is lightweight. This reduces workers' back strain and injuries, and also avoids the potential for injuries caused by dropping one batten or a group of battens. Also, the present lightweight batten does not result in excess weight on the roof itself when incorporated into the final design. This results in a batten that is durable and lightweight for the workers to easily carry up onto the roof. Additionally, there is no danger of wood slivers for the workers. The present batten may also preferably be made from environmentally-friendly recycled or reclaimed materials.

The present batten is preferably injection molded from a single integral block of material such that the elongated body, side walls and fastener housings can all be formed from the same block of material. The advantage of injection molding the present batten from a single integrated block of material is that it can be manufactured easily at low costs.

The present batten also preferably comprises a plurality of fastener housings positioned equidistantly at spaced-apart intervals along a length of the elongated body. These fastener housings each have an aperture that passes through the elongated body, with a top portion of the aperture being shaped to receive a countersunk screw head therein such that screws can be used to secure the batten in place. In contrast, traditional wooden battens simply use nails to be held in place. An advantage of using screws is that screws are more secure than traditional wood nails. In addition, the present use of screws avoids the potential for hammer injuries.

Preferably, the bottom of each of the fastener housings projects below the bottom of the elongated body to advantageously provide drainage channels under the batten when the batten is fixed into place on the roof.

In operation, the V-shaped notches in the side walls may: assist with the positioning of a pair of shears or snips at a preferred cutting distance along the batten; focus tearing or shearing or breaking forces at the tip of the V to help break apart the batten at the preferred location, or both. As such, the elongated body of the present batten can either be cut apart by a pair of shears positioned at one of the V-shaped notches, or manually broken apart by applying forces on opposite sides of one of the V-shaped notches. Alternatively, if a hand-saw (or power saw) is used to cut the batten, the V-shaped notches can advantageously be used as saw guides.

DETAILED DESCRIPTION OF THE DRAWINGS

Figure 1A:
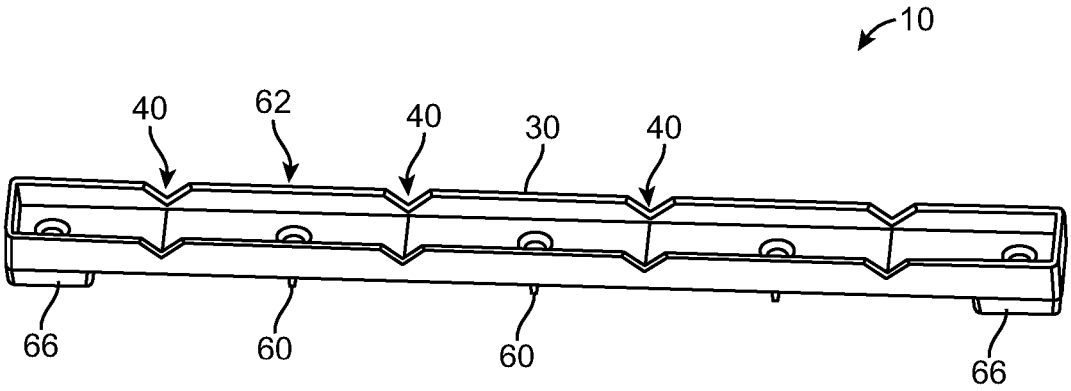
FIG. 1A is a top perspective view of the present batten.
Figure 1B:
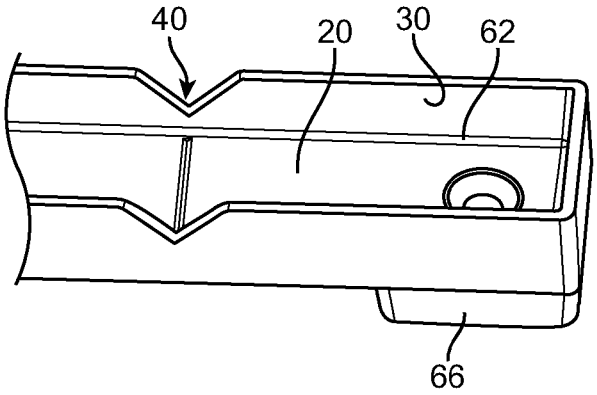
FIG. 1B is a close-up view of a portion of FIG. 1A.

FIGS. 1A to 6 illustrate various views of a first embodiment of the present batten, as follows: batten 10 comprises an elongated body 20; a pair of upwardly extending side walls 30 running along opposite sides of elongated body 10; and a plurality of pre-formed notches 40 in side walls 30. The pre-formed notches 40 are disposed at spaced-apart intervals along the length of each of side walls 30. Preferably, pre-formed notches 40 are spaced apart equidistantly from one another, and are V-shaped. As will be explained herein, notches 40 assist in cutting or breaking batten 10 into desired lengths such that measured sections of the batten can be removed (and the batten best sized to fit the job requirements). In this particular embodiment, batten 10 has a length of 12 inches, but it to be understood that the present invention encompasses battens of any length.

In preferred embodiments, roofing batten 10 is made of a plastic polymer. In one embodiment, the plastic polymer is a polypropylene homopolymer. However, it is to be understood that other suitable materials can be used instead. Plastic polymer materials have the advantages of having low moisture absorption resulting in long batten life. In addition, such materials are lightweight for ease of handling and reduced worker injuries. Moreover, such materials are chemically resistant to organic solvents, degreasing agents and electrolytic attack. The preferred materials also offer superior tensile strength.

Optionally, batten 10 may incorporate UV resistant materials (especially in scenarios where the batten is exposed to the environment). Preferably as well, such materials may also be heat tolerant to 200 F, or higher. This heat tolerance provides significant advantages over traditional wooden roofing battens. Such heat tolerance is especially important in the case of solar panel arrays positioned close to the battens.

Yet another advantage of forming the present batten from plastic polymers is that the elongated body 20, the pair of side walls 30 and the fastener housings 60 can all be formed from a single integrated block of plastic polymer material. Such a material can preferably be injection molded from high quality resin to ensure sequential parts are uniform and consistent. Such a preferred material can also be drilled or punctured without fracturing.

Figure 2A:
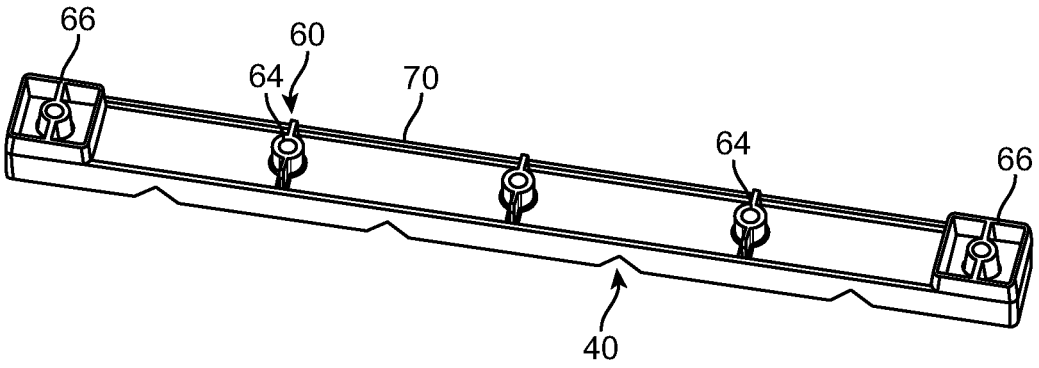
FIG. 2A is a bottom perspective view of the present batten.
Figure 2B:
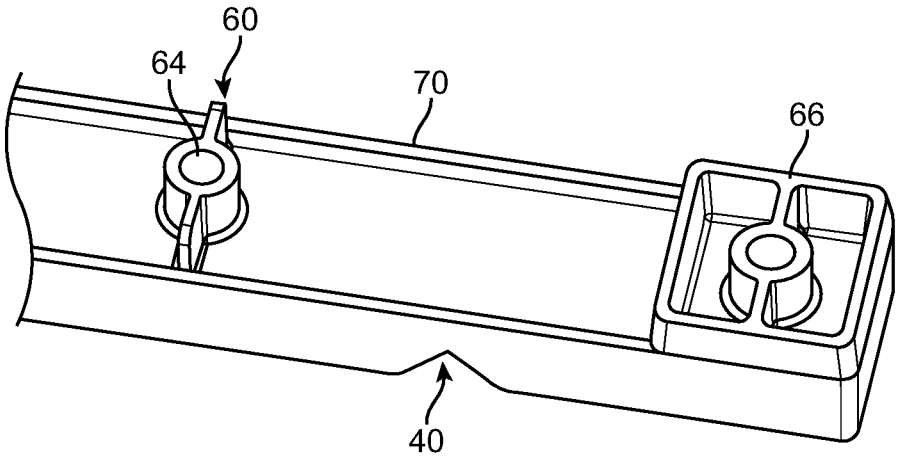
FIG. 2B is a close-up view of a portion of FIG. 2A.
Figure 3:
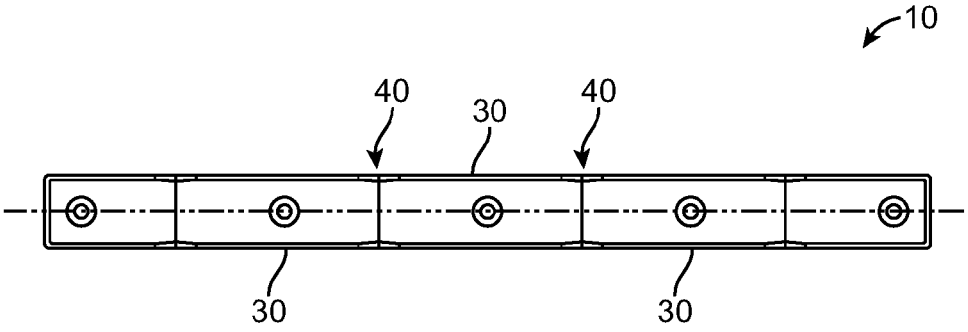
FIG. 3 is a top plan view of the present batten.

As seen best in FIG. 2B, an optional bottom perimeter rib 70 can be provided that extends downwardly from elongated body 20 can also be provided. Together, side walls 30 and bottom perimeter rib 70 each provide strength to the overall structure of the batten.

Figure 4:
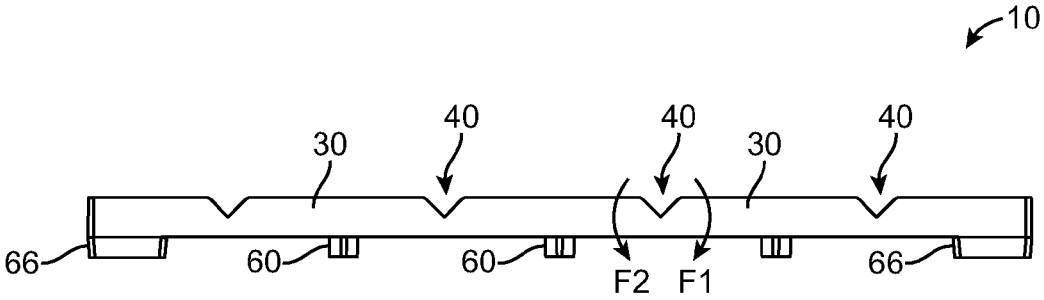
FIG. 4 is a side elevation view of the present batten.
Figure 5:
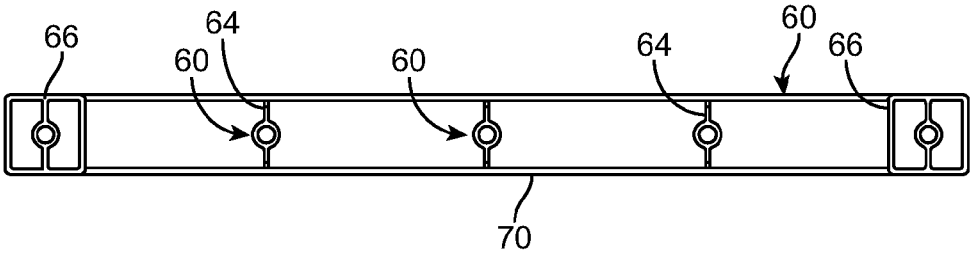
FIG. 5 is a bottom plan view of the present batten.
Figure 6:
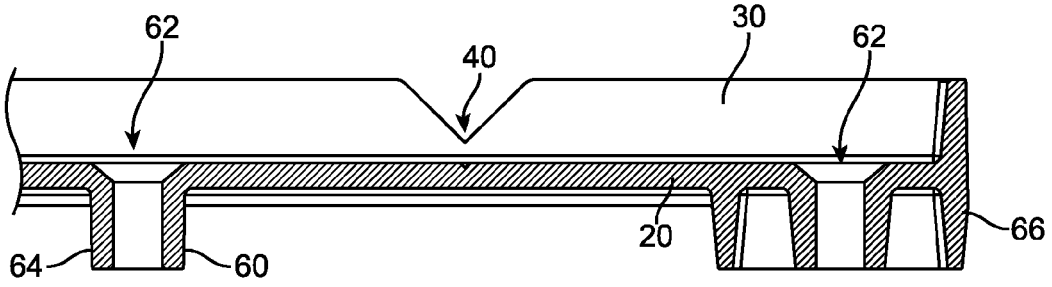
FIG. 6 is a sectional elevation view of an end of the present batten.

A plurality of fastener housings 60 are positioned at spaced-apart intervals along a length of the bottom of elongated body 20. As seen in FIG. 4, fastener housings 60 are preferably positioned equidistantly between pre-formed notches 40 in side walls 30. As best seen in the cross-sectional view of FIG. 6, each of fastener housings 60 can have an aperture 62 that passes through elongated body 20, with a top portion of aperture 62 being shaped to receive a countersunk screw head therein. As best seen in FIG. 2B, one embodiment of fastener housing 60 preferably has a supporting wall 64 passing transversely across elongated body 20.

At each of the ends of batten 10, an alternate fastener housing design can be provided. Specifically, as seen in FIG. 2B, fastener housing 66 has a box-shaped structure with walls 66 extending both transversely across elongated body 20 and also longitudinally along elongated body 20. These fastener housings 66 can be positioned at the ends of elongated body 20, as illustrated. Fastener housings 66 offer the advantages of added strength and stability at the ends of batten 10. It is to be understood that additional fastener housings 66 can be positioned mid-way along the length of batten 10, as desired. It is also to be understood that fastener housings 66 can conceivably replace any or all of the fastener housings 60 along the length of batten 10 as desired, all keeping within the scope of the present invention. Although one of end fastener housings 66 will be removed when batten 10 is shortened, it is to be understood that in many (if not most) situations, the full length of batten 10 will be used, and the batten will be affixed to the roof without being shortened. In such situations, having box-shaped fastener housings 66 at both ends of batten 10 will provide increased stability. In most work situations, the majority of battens 10 will be their full length in the final roof assembly, with only some of the battens being shortened as needed (using the present design's easy-to-remove pre-measured sections).

As best seen in FIG. 4, a bottom of each of the fastener housings 60 and 64 projects down below the bottom of elongated body 20. This gap (i.e.: the gap formed between bottom rib 70 and the bottom of the fastener housings 60 and 62) provides drainage channels between the fastener housings 60 and 64 when the batten is fastened to the roof.

The present batten 10 is secured to the roof by positioning screws 80 received into each of the apertures 62 in fastener housings 60. Screws offer improved security and stability as a means to attach batten 10 onto a roof (as compared to traditional nails used for holding wooden battens).

In accordance with the present invention, elongated body 20 can either be cut apart by a pair of shears positioned at one of the V-shaped notches 40, or optionally manually broken apart by applying forces on opposite sides of one of the V-shaped notches. Moreover, should a saw (hand or power) be used to cut the elongated body, the V-shaped notches can be used to guide the saw blade. As seen in FIG. 4, the application of forces F1 and F2 can optionally be used to break batten 10 at notch 40. The advantage of this approach is that the V-shape of the notch focuses the forces at the center of the notch such that the elongated body 20 is broken apart at the notch.

Figure 7:
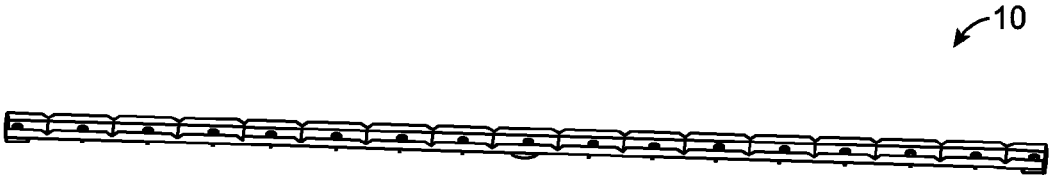
FIG. 7 is a perspective view of an alternate preferred length of the present batten.

FIG. 7 illustrates an alternate length (e.g.: 48 inches) of the present batten 10. It is to be understood that the length and width of the present batten can be varied, all keeping within the scope of the present invention.

Figure 8:
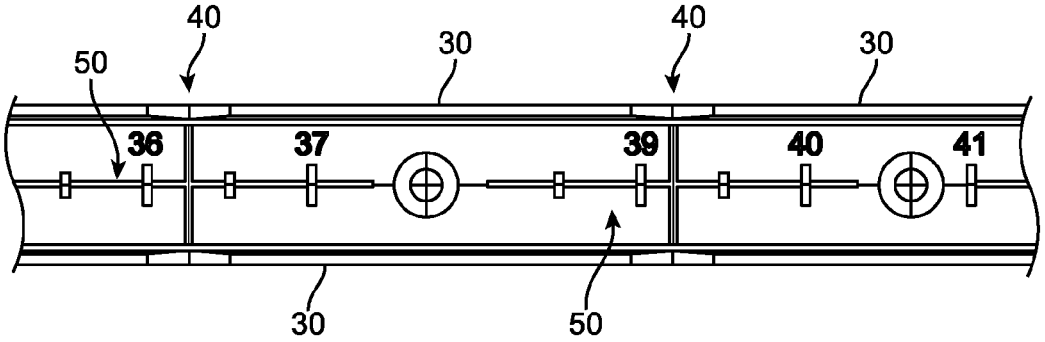
FIG. 8 is a top plan close-up showing the length indicia on the batten.

As seen in FIG. 8, indicia 50 are also printed or otherwise labelled on elongated body 20. Alternately, indicia 50 can be printed or otherwise labelled on side walls 30. Indicia 50 indicating measured lengths of the roofing batten at each of the pre-formed notches. As such, the worker knows the overall length of the batten when it is cut or broken to its desired length. In one optional embodiment, indicia 50 represent 1 inch lengths It is to be understood, however, that any suitable length can be used, all keeping within the scope of the present invention.

Figure 9:
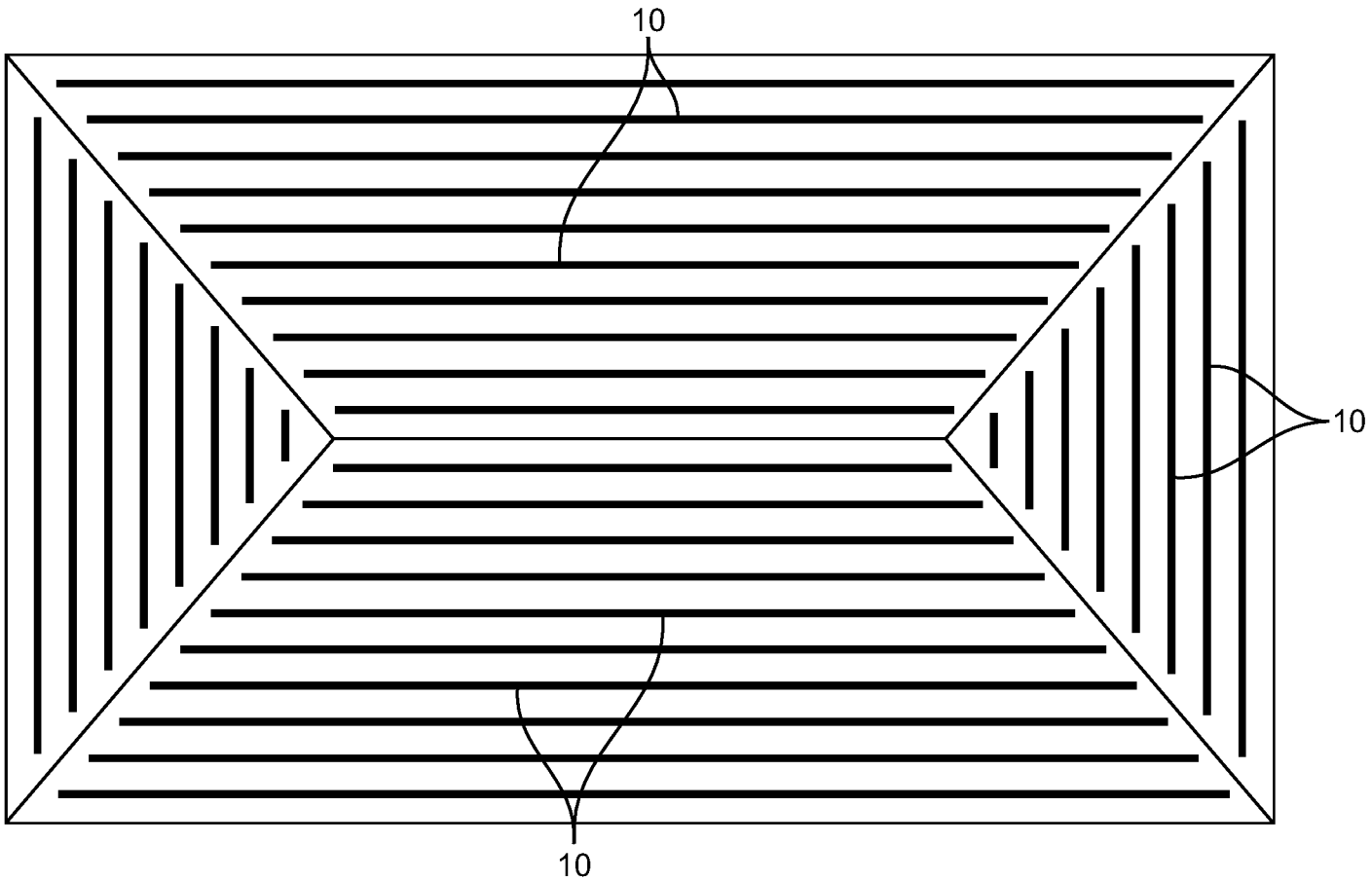
FIG. 9 is a top plan view of a number of battens attached to the roof of a building.

Lastly, FIG. 9 illustrates a top plan view of a number of battens 10 attached to the roof of a building. As can be seen, a typical roof geometry will necessitate battens of different lengths in its construction.

What is claimed is:

1. A roofing batten comprising:

an elongated body;

a pair of side walls extending upwardly along opposite sides of the elongated body;

a plurality of pre-formed notches in the side walls, the pre-formed notches being disposed at spaced-apart intervals along a length of each of the side walls; and a plurality of fastener housings positioned at spaced-apart intervals along a length of the elongated body, wherein the fastener housings are positioned equidistantly between the pre-formed notches in the side walls.

2. A roofing batten comprising:

an elongated body;

a pair of side walls extending upwardly along opposite sides of the elongated body;

a plurality of pre-formed notches in the side walls, the pre-formed notches being disposed at spaced-apart intervals along a length of each of the side walls; and a plurality of fastener housings positioned at spaced-apart intervals along a length of the elongated body, wherein a bottom of each of the fastener housings extends below the bottom of the elongated body to provide a drainage gap thereunder.

3. The roofing batten of claim 1, wherein the pre-formed notches are spaced apart equidistantly from one another.

4. The roofing batten of claim 1 or 2, wherein the pre-formed notches are V-shaped.

5. The roofing batten of claim 1 or 2, further comprising:

indicia on the elongated body, the indicia indicating measured lengths of the roofing batten at each of the pre-formed notches.

6. The roofing batten of claim 1 or 2, wherein each of the fastener housings has an aperture that passes through the elongated body, and wherein a top portion of each of the apertures are shaped to receive a countersunk screw head therein.

7. The roofing batten of claim 1 or 2, wherein each of the fastener housings has a supporting wall passing transversely across the bottom of the elongated body.

8. The roofing batten of claim 7, wherein the fastener housings positioned at the ends of the elongated body comprise a supporting box-shaped structure having walls extending both transversely across the elongated body and longitudinally along the elongated body.

9. The roofing batten of claim 1 or 2, further comprising:

a bottom perimeter rib extending downwardly from bottom edges of the elongated body.

10. The roofing batten of claim 1 or 2, wherein the batten is made of a plastic polymer.

11. The roofing batten of claim 1 or 2, wherein the batten is made of a UV resistant material.

12. The roofing batten of claim 6, further comprising:

a plurality of positioning screws, wherein each positioning screw is received into one of the apertures in the fastener housings.

13. The roofing batten of claim 1 or 2, wherein the elongated body and the pair of side walls are formed from an integrated block of material.

14. The roofing batten of claim 1 or 2, wherein the elongated body can be cut apart by a pair of shears positioned at one of the V-shaped notches.

15. The roofing batten of claim 1 or 2, wherein the elongated body can be manually broken apart by applying forces on opposite sides of one of the V-shaped notches.

* * * * *